US007926680B2

(12) United States Patent
Leitner

(10) Patent No.: US 7,926,680 B2
(45) Date of Patent: Apr. 19, 2011

(54) CARTON WITH INTERNAL CLIP RETAINER FOR DISPENSING CLIPS OF A STACKED SHEET MATERIAL

(75) Inventor: Charlcie Christie Kay Leitner, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 421 days.

(21) Appl. No.: 11/848,424

(22) Filed: Aug. 31, 2007

(65) Prior Publication Data

US 2009/0057330 A1 Mar. 5, 2009

(51) Int. Cl.
*B65H 1/08* (2006.01)
*B65H 1/00* (2006.01)
*A47K 10/24* (2006.01)

(52) U.S. Cl. ..... 221/59; 21/58; 21/57; 21/49; 21/33; 21/65; 21/56; 21/260; 21/47; 21/52; 21/45; 21/279; 21/63; 21/305; 21/48; 21/198; 21/255; 206/57 R; 220/23.83

(58) Field of Classification Search ..... 221/49, 221/50, 58, 65, 56, 57, 260, 47, 52, 45, 59, 221/279, 33, 63, 305, 48, 198, 255; 220/23.83; 206/57 R
See application file for complete search history.

(56) References Cited

U.S. PATENT DOCUMENTS 1,901,243 A * 3/1933 Horwitt ..... 221/279
2,435,104 A * 1/1948 Solomon ..... 221/57
3,202,316 A * 8/1965 Silver ..... 221/59
3,209,941 A * 10/1965 Krake ..... 221/48
3,313,583 A * 4/1967 Turkington et al. ..... 312/61
3,624,791 A * 11/1971 Taub ..... 221/59
3,647,114 A * 3/1972 Bleuer ..... 221/59
3,795,355 A 3/1974 Gerstein
3,823,845 A * 7/1974 Mott et al. ..... 221/59
3,942,682 A * 3/1976 McKay ..... 221/58
4,231,491 A * 11/1980 Pierson et al. ..... 221/48
4,329,001 A * 5/1982 Filipowicz et al. ..... 312/71
(Continued)

FOREIGN PATENT DOCUMENTS

EP 0 501 260 9/1992
(Continued)

OTHER PUBLICATIONS

PCT Search Report, Mar. 30, 2009.

*Primary Examiner* — Gene O. Crawford
*Assistant Examiner* — Rakesh Kumar
(74) *Attorney, Agent, or Firm* — Dority & Manning, P.A.

(57) ABSTRACT

A dispenser for dispensing a clip of stack sheets of a web material includes a carton body defined by a bottom, sidewalls, and a lid. The carton body defines an internal volume for receipt of a clip of stacked sheets of a web material. The lid includes a dispensing opening through which individual sheets from the clip of stacked sheets are pulled by a user. A clip retainer extends from an underside of the lid towards the bottom within the internal volume of the carton body and is configured for receipt of the clip of stacked sheets therethrough such that a center portion of the clip is at least partially folded and held at an elevation above the bottom of the carton and towards the dispensing opening in the lid.

18 Claims, 3 Drawing Sheets

U.S. PATENT DOCUMENTS

| | | | | | |
|---|---|---|---|---|---|
| 4,411,374 | A | | 10/1983 | Hotchkiss | |
| 4,616,767 | A | * | 10/1986 | Seido | 221/58 |
| 4,765,482 | A | * | 8/1988 | Delia | 206/555 |
| 4,765,579 | A | | 8/1988 | Robbins, III et al. | |
| 4,838,454 | A | * | 6/1989 | Salzmann et al. | 221/57 |
| 5,076,466 | A | * | 12/1991 | Petterson et al. | 221/46 |
| 5,332,117 | A | * | 7/1994 | Yadegar | 221/33 |
| 5,540,354 | A | | 7/1996 | Annand | |
| 5,667,092 | A | * | 9/1997 | Julius et al. | 220/259.1 |
| 5,746,318 | A | | 5/1998 | Batchelor | |
| D407,974 | S | | 4/1999 | Zimmer et al. | |
| 5,979,700 | A | * | 11/1999 | Suess | 221/56 |
| 5,992,683 | A | * | 11/1999 | Sigl | 221/59 |
| 6,202,889 | B1 | * | 3/2001 | Veith | 221/58 |
| 6,213,345 | B1 | | 4/2001 | Plank | |
| 6,412,634 | B1 | | 7/2002 | Telesca et al. | |
| 6,585,130 | B2 | * | 7/2003 | Turbett et al. | 221/45 |
| D501,636 | S | | 2/2005 | Melhede | |
| 7,028,860 | B2 | * | 4/2006 | Behnke et al. | 221/49 |
| D530,223 | S | | 10/2006 | Mau et al. | |
| 7,178,689 | B2 | * | 2/2007 | Wieser et al. | 221/52 |
| 7,661,553 | B2 | * | 2/2010 | Zeiron | 221/46 |
| 2006/0237474 | A1 | | 10/2006 | Long | |
| 2007/0284266 | A1 | * | 12/2007 | McDonald et al. | 206/233 |

FOREIGN PATENT DOCUMENTS

| | | |
|---|---|---|
| GB | 2 244 472 | 12/1991 |
| JP | 06-080174 | 3/1994 |
| JP | 08-318978 | 12/1996 |
| JP | 2002-223981 | 8/2002 |
| WO | WO 2005/120985 | 12/2005 |

* cited by examiner

CARTON WITH INTERNAL CLIP RETAINER FOR DISPENSING CLIPS OF A STACKED SHEET MATERIAL

BACKGROUND OF THE INVENTION

Facial tissue cartons come in a wide variety of shapes and sizes but they can generally be classified as either one of two basic styles. One style is the flat carton and the other is the upright carton. In a flat carton, the tissues are laid flat into the carton and are withdrawn from the top of the carton or through an opening in the top which partially extends downward into the front sidewall. The tissues within the carton may be interfolded for pop-up dispensing or merely laid on top of one another for reach-in dispensing. In an upright carton, the tissues are folded into an inverted U-shaped clip and are interfolded for pop-up dispensing. Each tissue is singularly withdrawn through a dispensing opening in the top of the carton, which may contain a polymeric film having a slit to hold the popped up tissue in place.

Both types of facial tissue cartons can experience dispensing problems after the number of tissues within the carton is reduced. This dispensing problem is primarily concerned with what is known by those skilled in the art as "fall back." Fall back occurs as the number of tissues within the carton is reduced and the distance between the uppermost tissue and the dispensing opening in the top of the carton increases. This can cause the uppermost tissue to fall back into the box rather than being retained by the opening for ready removal. In flat cartons having an opening in the front wall, each tissue has a flat orientation relative to an adjacent tissue and the dispensing opening is usually of a large size. These two features facilitate the insertion of a consumer's fingers into the carton such that the uppermost tissue can be grasped and removed. Upright cartons present a distinct difference in that the tissues retained in the carton are folded into an inverted U-shape and the dispensing opening is usually of a smaller size than that formed in flat cartons. Because of these two features, the problem associated with trying to withdraw the uppermost tissue after it has fallen back into the carton is more difficult with upright carton configurations.

For upright carton dispensers, it is known in the art to provide a bottom support member, such as a wedge shaped member, under the clip of stacked sheets to maintain the clip in close proximity to the dispensing opening or aperture in the top surface. Reference is made for example to U.S. Pat. No. 6,202,889.

Non-rectangular shaped upright dispensers, such as oval, oblong, elliptical, and the like, shaped dispensers are becoming increasingly popular with the consuming public. Such dispensers, for instance, may be considered by consumers to improve the aesthetics of the product, especially facial tissue products where dispensers are sometimes displayed in plain view around a person's home. Oval or other rounded and elongated dispensers may also be appealing and fanciful to children, thus encouraging them to use the product for improving their hygiene habits. Unique and stylistic-shaped dispensers may also allow manufacturers to better differentiate their products from the products of others and to otherwise indicate quality.

The oval and other curved sidewall upright cartons present the same "fall back" issue discussed above, and other unique challenges to the manufacturer due to the rounded nature of the carton. For example, efficient loading of a clip of stacked sheets within the rounded carton is an issue. Also, retention of the clip within the carton adjacent to the dispensing opening to ensure dispensing of all of the sheet products is more difficult due to the rounded sidewalls of the carton.

In view of the above, the present invention relates to a novel upright carton dispenser particularly suited for curved sidewall containers or any other suitable complex shape.

SUMMARY OF THE INVENTION

Objects and advantages of the invention will be set forth in part in the following description, or may be obvious from the description, or may be learned through practice of the invention.

In general, the present invention is directed to an upright carton dispenser for dispensing individual sheets from a clip of stacked sheets contained within the dispenser. Although the dispenser is particularly suited for dispensing facial tissues, this use is not a limitation of the dispenser. The clip of stacked sheet material may comprise, for instance, any suitable tissue product or textile product. For instance, the sheet material may comprise a tissue product, such as a facial tissue, a stacked bath tissue product, premoistened wipers, industrial wipers, napkins, stacked paper towels, other various wipers, and the like. In other embodiments, the sheet material may comprise stacked layers of nonwoven webs, such as meltblown webs, spunbond webs, hydroentangled webs, webs containing a mixture of cellulose fibers and synthetic fibers, and laminates thereof. The clips may contain the sheet material as individual sheets that can be interfolded together or as a folded continuous sheet that includes perforation lines for separating one sheet from the stack.

In a particular embodiment, the dispenser includes a carton body defined by a bottom, sidewall(s), and a lid, the carton body defining an internal volume for receipt of a clip of stacked sheets of a web material. Although the dispenser has particular usefulness as a curved wall dispenser, such as an oval, elliptical, oblong, or racetrack shaped carton with a continuous sidewall, it may also be embodied as a rectangular shaped carton with a segmented sidewall. The lid has a dispensing opening through which individual sheets from the clip of stacked sheets are pulled by a user.

A clip retainer extends from an underside of the lid towards the bottom within the internal volume of the carton body. This clip retainer is configured for receipt of the clip of stacked sheets therethrough such that a center portion (with respect to a longitudinal axis of the carton body) of the clip is at least partially folded and suspended by the clip retainer at an elevation above the carton bottom and towards the dispensing opening in the carton lid. The clip retainer may include any suitable structure. For example, the retainer may include a rigid structure with an opening through which the clip of stacked sheets is inserted. A bottom surface of the opening may define a holding surface against which the clip of stacked sheets rests and is at least partially folded over. The opening may include at least one sidewall that engages against a side of the clip of stacked sheets. In a particular embodiment, the opening is generally rectangular or square and defined by arm members that extend vertically downward from the underside of the lid on opposite sides of the dispensing opening. The arms may also define sidewalls that engage against the side of the clip.

The clip retainer may have a bottom edge or structure that extends essentially to a location directly adjacent to the bottom of the carton body. This configuration adds substantially structural rigidity to the carton and may prevent collapse of the carton from above and from the side.

The clip retainer may be a member that is separately formed and adhered or otherwise attached to the underside of the carton lid. In alternative embodiments, the clip retainer may be integrally formed with the lid.

As mentioned, the carton body may take on various shapes. In certain embodiments, the carton body has an elongated shape with a longer Y axis and shorter X axis, with the clip retainer oriented with its holding surface along the shorter X axis. With this configuration, the clip of stacked sheets is longitudinally oriented within the carton body along the longer Y axis and partially folded over the holding surface at a fold line oriented along the X axis.

The carton lid may be removable from the carton sidewalls so that a refill clip of stacked sheets can be inserted into said clip retainer.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
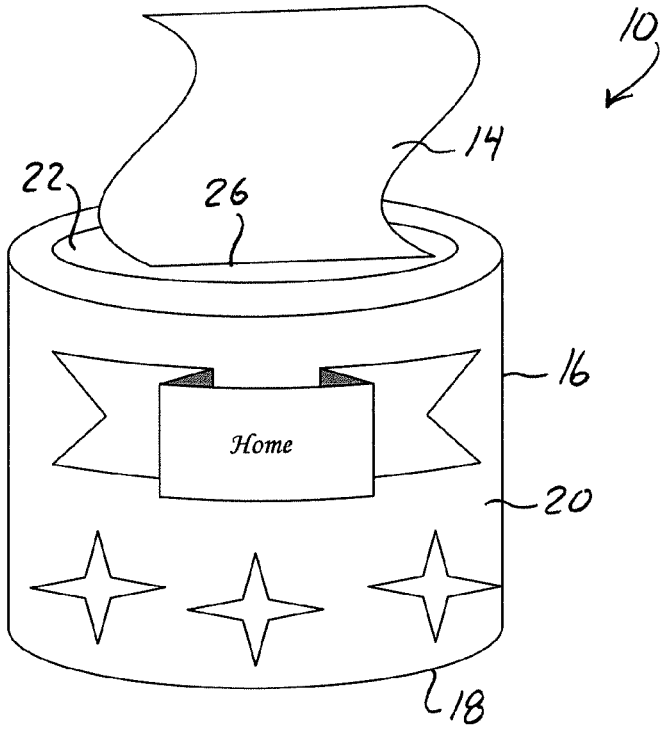
FIG. 1 is a perspective view of one embodiment of a decorative sheet material dispenser.
Figure 2:
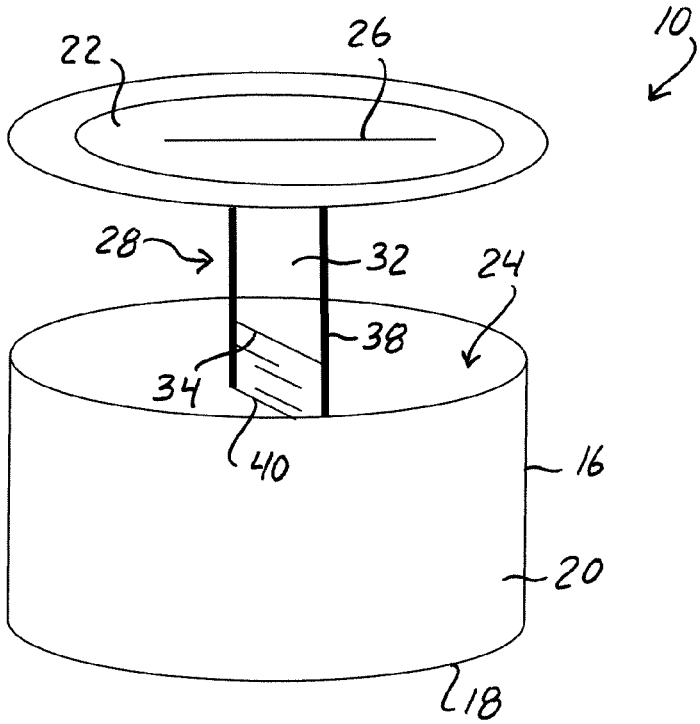
FIG. 2 is a partial component view of the dispenser of FIG. 1.

Repeat use of reference characters in the present specification and drawings is intended to represent the same or analogous features or elements of the present invention.

DETAILED DESCRIPTION

Reference will now be made in detail to one or more embodiments of the invention, examples of which are illustrated in the figures. It should be understood that each embodiment is provided by way of explanation of the invention, and not meant as a limitation of the invention. Features illustrated or described with respect to one embodiment may be used with another embodiment to yield still a further embodiment.

In general, a dispenser 10 is illustrated for dispensing individual sheets 14 of a web material from a clip 12 of stacked sheets contained within the dispenser. Although the dispenser 10 is particularly suited for dispensing facial tissues, this use is not a limitation of the dispenser. The clip of stacked sheet material 12 may comprise, for instance, any suitable tissue product or textile product. For instance, the sheet material may comprise a tissue product, such as a facial tissue, a stacked bath tissue product, premoistened wipers, industrial wipers, napkins, stacked paper towels, other various wipers, and the like. In other embodiments, the sheet material may comprise stacked layers of nonwoven webs, such as melt-blown webs, spunbond webs, hydroentangled webs, webs containing a mixture of cellulose fibers and synthetic fibers, and laminates thereof. The clips may contain the sheet material as individual sheets that can be interfolded together or as a folded continuous sheet that includes perforation lines for separating one sheet from the stack.

In particular embodiments, the dispenser 10 includes a carton body 16 defined by a bottom 18, sidewall or walls 20, and a lid 22. The carton body 16 may be made of any conventional material known and used in the construction of dispenser cartons. The carton body 16 defines an internal volume 24 for receipt of the clip of stacked sheets 12. Although the dispenser 10 has particular usefulness as a curved wall dispenser, such as the oval dispenser 10 illustrated in the figures, the dispenser 10 may embody an elliptical, oblong, or racetrack shaped carton. The dispenser 10 may also embody a rectangular shaped carton. The lid 22 has a dispensing opening 26 through which individual sheets 14 from the clip of stacked sheets 12 are pulled by a user. This opening 26 may be a slit (linear, X-shaped, or other profile) defined in a paperboard or film portion of the lid 22, and may be sealed by a paperboard "surfboard", film, or other material prior to use of the dispenser.

Figure 3:
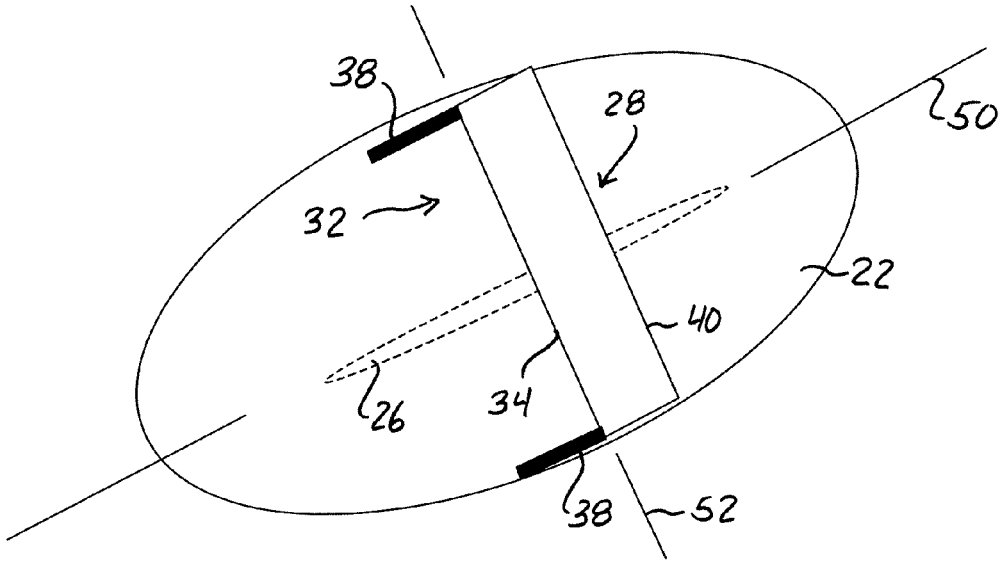
FIG. 3 is an underside view of the lid component of the dispenser of FIG. 1.
Figure 4:
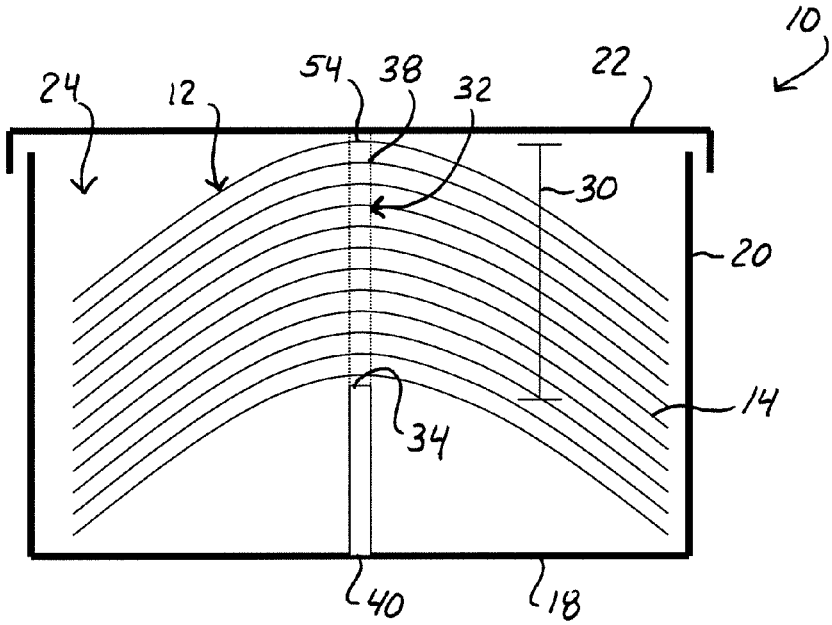
FIG. 4 is a cutaway plan view of the dispenser of FIG. 1.

A clip retainer 28 extends from an underside of the lid 22, as depicted in FIG. 3, within the internal volume 24 of the carton body 16 towards the bottom 18. This clip retainer 28 may be formed of any suitable structure or material and is configured for receipt of the clip of stacked sheets 12 therethrough such that a center portion (with respect to a longitudinal axis of the carton body) of the clip 12 is at least partially folded along a fold axis 54 (FIG. 4) and suspended by the clip retainer 28 at an elevation above the carton bottom 18 and towards the dispensing opening 26 in the carton lid 22. In the illustrated embodiment, the clip retainer 28 may include a rigid structure with an opening 32 through which the clip of stacked sheets 12 is inserted. A bottom surface 34 of the opening may define a holding surface against which the clip of stacked sheets 12 rests and is at least partially folded over. The opening 32 may include at least one sidewall 36 that engages against a side of the clip of stacked sheets 12. In the illustrated embodiment, the opening 32 may be generally rectangular or square and is defined by arm members 38 that extend vertically downward from the underside of the lid 22 on opposite sides of the dispensing opening 26. The arms 38 may also define opposite sidewalls that engage against the side of the clip 12.

Figure 5:
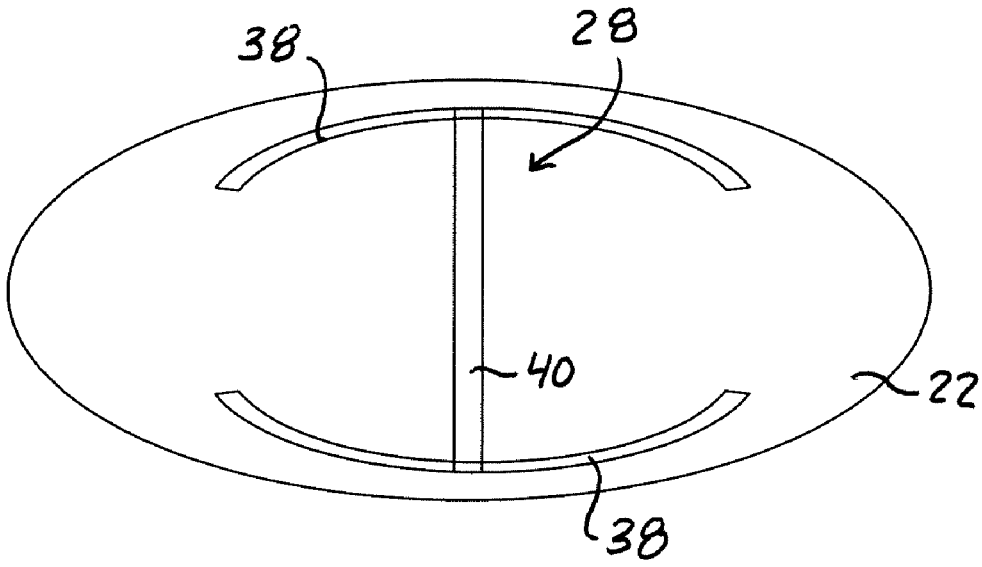
FIG. 5 is a bottom plan view of an alternate arrangement of the clip retainer mechanism.

The arms 38 may have any useful shape. For example, the arms 38 may be rail-like members, as illustrated in the FIGS. 1 through 4. In an alternate embodiment, for example as illustrated in FIG. 5, the arms 38 may have a longitudinally elongated shape. For instance, the arms 38 may have a rounded or curved shape and could be shaped to extend essentially flush along a portion of the inner surface of the dispenser sidewall upon placement of the lid 22 onto a carton body. This embodiment would add structural rigidity to the overall dispenser 10.

The clip retainer 28 may have a bottom edge 40 or other spacing structure that extends essentially to a location directly adjacent to the bottom 18 of the carton body 16. This configuration adds substantially structural rigidity to the carton and may prevent collapse of the carton from above or from the side.

The retainer 28 should serve to minimize the occurrence of fallback in general. In the event of a fallback situation, however, the holding surface defined by the bottom surface 34 of the opening 32 (referring to FIG. 4) may be at a height 30 from the lid 22 such that a user may insert a finger or fingers through the opening 26 and reach bottom sheets within the stack 12 in the event that sheets fall back within the dispenser 10, or fail to be drawn out with the preceding sheet.

The clip retainer 28 may be a member that is separately formed and adhered or otherwise attached to the underside of the carton lid 22. In alternative embodiments, the clip retainer may be integrally formed with the lid, or may comprise a member in a folded or flat condition against the underside of the lid 22 that is folded out by the user prior to insertion of the clip 12 into the dispenser, particularly in the case of a refillable dispenser. In this regard, it should be understood that the carton lid may be removable from the carton sidewalls 20 so that a refill clip of stacked sheets 12 can be inserted into the clip retainer 28.

Figure 6:
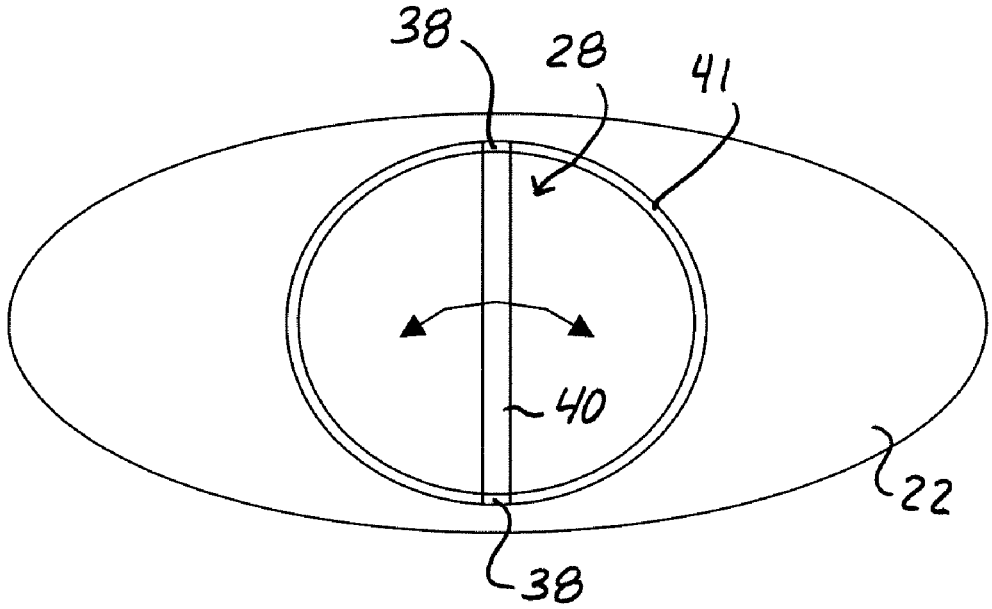
FIG. 6 is a bottom plan view of still another embodiment of the clip retainer mechanism.

As mentioned, the carton body 16 may take on various shapes. In certain embodiments, the carton body has an elongated shape with a longer Y axis 50 (FIG. 4) and shorter X axis 52, with the clip retainer 28 oriented with its holding surface 42 along the shorter X axis. With this configuration, the clip of stacked sheets 12 is longitudinally oriented within the carton body 16 along the longer Y axis and partially folded over the holding surface 34 at the fold axis 54 oriented along the X axis. It should be understood that an opposite embodiment is also contemplated wherein the clip retainer 28 is oriented along the longer Y axis, with the clip of stacked sheets folded over the holding surface 34 at a fold axis oriented along the Y axis. To accommodate various sizes and types of sheet clips, the clip retainer 28 may be movable relative to the bottom of the lid 22 between different orientations. For example, referring to the embodiment of FIG. 6, the clip retainer 28 may rotate within a groove or slot 41 defined on the underside of the lid 22 between an X axis orientation and a Y axis orientation.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A dispenser for dispensing a clip of stack sheets of a web material, comprising:

a carton body defined by a bottom, sidewalls, and a lid, said carton body defining an internal volume for receipt of a clip of stacked sheets of a web material;

said lid comprising a dispensing opening through which individual sheets from the clip of stacked sheets are pulled by a user;

a rigid structure clip retainer configured on and extending from an underside of the lid towards said bottom within said internal volume of said carton body, said clip retainer configured for receipt of the clip of stacked sheets therethrough such that a center portion of said clip is at least partially folded and held at an elevation above said bottom and towards said dispensing opening in said lid; and wherein said lid is removable from said carton body with said clip retainer configured on said underside of said lid such that a refill clip of stacked sheets is insertable into said clip retainer.

2. The dispenser as in claim 1, wherein said clip retainer comprises an opening through which the clip of stacked sheets are inserted, a bottom surface of said opening defining a holding surface against which the clip of stacked sheets rests, said opening comprising at least one sidewall that engages against a side of the clip of stacked sheets.

3. The dispenser as in claim 2, wherein said rigid structure comprises arms extending vertically downward from opposite sides of said dispensing opening, said arms defining said sidewalls of said opening.

4. The dispenser as in claim 2, wherein said opening is generally rectangular shaped.

5. The dispenser as in claim 1, wherein said clip retainer comprises a bottom edge that extends to adjacent said bottom of said carton body.

6. The dispenser as in claim 1, wherein said clip retainer is formed separately from said lid and attached to said underside of said lid.

7. The dispenser as in claim 1, wherein said carton body has an elongated shape with a longer Y axis and shorter X axis, said clip retainer oriented with said clip holding surface along said shorter X axis with the clip of stacked sheets longitudinally oriented within said carton body along said longer Y axis.

8. The dispenser as in claim 7, wherein said carton body has an oval shape.

9. The dispenser as in claim 1, wherein said clip retainer is foldable relative to said lid.

10. The dispenser as in claim 1, wherein said clip retainer is movable relative to said lid between different dispensing orientations.

11. A dispenser for dispensing a clip of stack sheets of a web material, comprising:

a carton body defined by a bottom, sidewalls, and a lid, said carton body defining an internal volume, said carton body having an elongated shape with a longer Y axis and shorter X axis;

said lid comprising a dispensing opening through which individual sheets from the clip of stacked sheets are pulled by a user;

a clip of stacked sheets carried within said internal volume of said carton body; said clip disposed longitudinally along said longer Y axis;

a rigid structure clip retainer configured on and extending from an underside of said lid towards said bottom within said internal volume of said carton body, said clip of stacked sheets extending through said clip retainer such that a center portion of said clip is at least partially folded along said X axis and held at a static elevation above said bottom and towards said dispensing opening in said lid; and wherein said lid is removable from said carton body with said clip retainer extending from said underside of said lid such that a refill clip of stacked sheets is insertable into said clip retainer.

12. The dispenser as in claim 11, wherein said clip retainer comprises a clip holding surface oriented along said shorter X axis.

13. The dispenser as in claim 11, wherein said clip retainer comprises an opening through which said clip of stacked sheets is inserted, a bottom surface of said opening defining said holding surface against which said clip of stacked sheets rests.

14. The dispenser as in claim 13, wherein said opening comprises at least one sidewall that engages against a side of said clip of stacked sheets.

15. The dispenser as in claim 14, wherein said rigid structure comprises arms extending vertically downward from opposite sides of said dispensing opening, and a horizontal cross member that defines said holding surface, said arms defining sidewalls of said opening.

16. The dispenser as in claim 11, wherein said clip retainer comprises a bottom edge that extends to adjacent said bottom of said carton body.

17. The dispenser as in claim 11, wherein said clip retainer is formed separately from said lid and attached to said underside of said lid.

18. The dispenser as in claim 11, wherein said carton body has an oval shape.

* * * * *